US006302829B1

(12) United States Patent
Schmidt

(10) Patent No.: US 6,302,829 B1
(45) Date of Patent: Oct. 16, 2001

(54) SPEED-CONTROL EXERCISE METHOD AND APPARATUS

(76) Inventor: David H. Schmidt, 10 Juniper Rd., Rowayton, CT (US) 06853

( * ) Notice: Subject to any disclaimer, the term of this patent is extended or adjusted under 35 U.S.C. 154(b) by 0 days.

(21) Appl. No.: 08/865,235

(22) Filed: May 29, 1997

Related U.S. Application Data

(60) Provisional application No. 60/018,755, filed on May 31, 1996.

(51) Int. Cl.[7] ..... A63B 21/00; A63B 1/00

(52) U.S. Cl. ..... 482/70; 482/51

(58) Field of Search ..... 482/51, 57, 70, 482/54, 52, 71

(56) References Cited

U.S. PATENT DOCUMENTS 3,941,377 * 3/1976 Lie ..... 482/70
4,867,443 * 9/1989 Jensen ..... 482/70
4,900,013 * 2/1990 Rodgers ..... 482/70
5,192,257 * 3/1993 Panasewicz ..... 482/70
5,277,678 * 1/1994 Friedebach et al. ..... 482/70
5,328,422 * 7/1994 Nichols ..... 482/54
5,368,533 * 11/1994 Feuer et al. ..... 482/70
5,407,409 * 4/1995 Tang ..... 482/70
5,429,567 * 7/1995 Gerschefske et al. ..... 482/70
5,792,026 * 8/1998 Maresh et al. ..... 482/51
5,792,029 * 8/1998 Gordon ..... 482/70

* cited by examiner

*Primary Examiner*—Stephen R. Crow
(74) *Attorney, Agent, or Firm*—Cook, Alex, McFarron, Manzo, Cummings & Mehler, Ltd.

(57) ABSTRACT

An exercise device usable for closely simulating natural exercise is provided. Preferably exercise is provided which presents resistance to both backward leg movement and forward leg movement. Preferably the apparatus can be configured to control speed based on the fore-aft position of the user and without the need for inputting controls, instructions or adjustments manually. Preferably, the device provides for arm exercise which permits the arms to be moved alternately, in parallel, one at a time, or not at all. In one embodiment the same resistance device which provides resistance to leg movement also provides resistance to arm movement, e.g., such that an increase in arm exercise permits a decrease in leg exercise effort while maintaining a constant level of overall effort or speed.

30 Claims, 10 Drawing Sheets

SPEED-CONTROL EXERCISE METHOD AND APPARATUS

This application claims priority based on U.S. provisional application Ser. No. 60/018,755 filed May 31, 1996 which is incorporated herein by reference.

The present invention relates to an apparatus for performing exercise and a method for using such apparatus and in particular to an apparatus which closely simulates many natural forms of exercise such as cross-country skiing, walking, running, biking, climbing and the like.

BACKGROUND INFORMATION

Many forms of natural exercise (i.e., exercise performed without the use of a stationary exercise machine) provide numerous benefits to an exerciser. In a number of types of natural exercise, a bilateral motion is performed of such a nature that as muscle groups on one side of the body are used, e.g., to attain forward motion in a motive type of exercise, there is simultaneously some amount of resistance to muscle groups on the other side of the body, typically opposing types of muscle groups, so that both extension and flexion muscle groups are exercised. In a typical bilateral exercise such as cross-country skiing, the exerciser utilizes, e.g., gluteus maximus and hamstring muscles in the backward stroke and, simultaneously, on the opposite side, quadriceps and hip flexor muscles in the forward stroke. Cross-country skiing is one example of such an exercise. During cross-country skiing, while there is some resistance between the ski and the snow when sliding in either the forward or rearward direction, there is much greater resistance to sliding in the rearward direction. Thus in cross-country skiing, when a user pushes backward with the trailing, e.g., left foot, sliding forward with the opposite, right, foot, both sides of the body meet some amount of sliding resistance, although resistance to movement of the rearward direction is much greater.

Although various attempts have been made to simulate cross-country ski exercise or other bilateral exercise on a stationary exercise machine, these attempts have not been fully successful in reproducing the experience with sufficient accuracy to provide many of the health benefits of natural exercise. For example, in some ski-type exercise devices, while the trailing limb encounters resistance, the opposite limb encounters virtually no resistance (typically only resistance from friction of moving machine parts). As a result, many such previous devices include a feature intended to counteract the force of the backward thrusting limb, such as an abdomen pad which receives the forward thrust of the exerciser's body as the exerciser pushes backward against resistance with each leg in an alternating fashion. It is believed that in such machines, pushing against the abdominal pad can lead to lower back stress and fatigue and detracts from an accurate simulation of the natural cross-country ski exercise. It is further believed that the lack of forward resistance and the associated lack of balance in such devices leads to a long learning curve such that, to successfully use the machine, a user must develop a new technique for walking or skiing which is very different from that found in nature.

Another feature of many natural bilateral exercises such as skiing, walking, running, jogging, bicycle riding, etc., is that, while the exerciser may, on the average, move forward, the velocity of the user oscillates. Typically, an exerciser accelerates, e.g. while pushing backward with one leg, decelerates, momentarily accelerates again when pushing backward with the opposite leg, decelerates again, and so forth. As a result, in many natural bilateral exercises, although the exerciser maintains a constant average speed, in fact if one were to travel alongside the exerciser at such constant speed, the exerciser would appear to be oscillating forward and backward with respect to the observer. This constant change in acceleration is natural to most forms of human propulsion involving an alternating stride such as walking, running, bicycling, etc.

Again, it is believed that many exercise devices fail to reproduce this feature of the natural exercise with sufficient accuracy to provide an enjoyable exercise experience and to provide all the benefits available with natural exercise, such as a more natural and less stressful distribution of force on the joints and development of good balance. For example, with the above-described ski exercise machine, the exerciser is typically pushing against the abdominal pad during substantially most or all of the exercise, thus causing the exerciser to stay in substantially the same position rather than accelerate and decelerate in an oscillating manner as in natural skiing exercise.

A number of forms of natural exercise provide exercise benefits to the upper body as well as the lower body of the exerciser. For example, in cross-country skiing, the exerciser typically pushes using poles. A number of features of the upper body exercise in natural exercise settings are of interest in the context of the present invention. For example, during cross-country skiing, the arm and leg motions are related such that, if a skier is maintaining a constant average speed, exerting greater upper body effort ("poling" with the arms) results in less effort being exerted by the legs, and vice versa. Further, in cross-country skiing, although the arm and leg energy exertions are related, the left and right upper body exertions are independent in the sense that the user does not need to pole in an alternating fashion, much less a fashion which is necessarily synchronized with the leg motions. A cross-country skier may "double pole", i.e., pushing with both poles at the same time, or may, if desired, push with only a single pole or no poles for a period of time. Another feature of cross-country skiing is that, while the skier is moving, when a pole is plunged into the snow, the pole engages a resistance medium which, relative to the skier, is already in motion, thus providing a what may be termed "kinetic resistance".

Many types of previous exercise devices have failed to provide a completely satisfactory simulation of natural upper body exercise. For example, many previous ski devices provided only for dependent arm motion, i.e., such that the arms were essentially grasping opposite ends of the rope wound around a spindle. In such devices, as the left arm moved backward, the right arm was required to simultaneously move forward substantially the same amount. Thus it was impossible to accurately simulate double poling or poling with a single arm. Many previous devices provided upper body resistance that was entirely unrelated to lower body resistance. In such devices, if an exerciser was expending a given level of effort, by exerting greater upper body efforts, the user was not, thereby, permitted to correspondingly decrease lower body exercise while maintaining the same overall level of effort. Many previous devices having upper body resistance mechanisms provided what may be termed "static resistance" such that when the arm motion began, such as by thrusting or pushing, or pulling backward with one arm, the resistance device was being started up from a stopped position, typically making it necessary to overcome a coefficient of static friction and detracting from the type of kinetic or dynamic resistance experienced in the natural cross-country ski exercise.

Many types of exercise devices establish a speed or otherwise establish a level of user effort in such a fashion that the user must manually make an adjustment or operate a control in order to change the level of effort. Even when an exercise device has a microprocessor or other apparatus for automatically changing levels of effort, these changes are pre-programmed and the user cannot change the level of effort to a level different from the pre-programmed scheme without manually making an adjustment or providing an input or control during the exercise. For example, often a treadmill-style exercise machine is configured to operate at a predetermined speed or series of pre-programmed speeds, such that when the user wishes to depart from his or her predetermined speed or series of speeds, the user must make an adjustment or provide other input. In contrast, during natural exercise such as running, the user may speed up, slow down, or rest at will.

Accordingly, it would be useful to provide an exercise device and method which provides a more natural exercise feel, more closely simulates a variety of different natural exercises such as skiing, walking, running, bicycling, etc., exercises both extension and flexion muscle groups, provides for automatic and/or hands-free adjustment in a reaction to the level of user effort, and in general provides for safe, effective and enjoyable exercise experiences on a stationary exercise device.

SUMMARY OF THE INVENTION

The present invention involves an apparatus and a method for exercise which closely simulates a number of aspects of natural exercise. The invention can be used for simulating many types of exercise including, in various embodiments, simulating cross-country skiing, walking, running, bicycling, climbing and the like. The invention can include, in various combinations, any or all of a one-way friction element, an isokinetic arm motion, and/or a speed controller.

In one embodiment, a one-way friction element is implemented by means of a one-way clutch mechanism. In a ski simulator, the user stands in simulated skis or sliders which engage the clutch when a force is exerted in a rearward direction. The clutch drives a flywheel or other controllable momentum device whose speed is regulated as described below. When the leading leg is pushed forward, a one-way braking engagement element is engaged to simulate the resistance a ski would encounter sliding forward through the snow. In one embodiment, this one-way brake is tied to the one-way clutch such that forward resistance is only encountered relative to the moving flywheel and not the frame of the machine, e.g., by applying a brake pad against the one-way clutch with the brake mounted to and rotating with the flywheel shaft. Preferably the one-way brake is made adjustable so as to simulate the varying snow conditions encountered while cross-country skiing. This method enables the machine to have virtually no external resistance, thereby allowing for an adjustable balance between leading leg and trailing leg which closely simulates that found in natural cross-country skiing exercise. In one embodiment, the ski device can be used without the need for an abdominal support pad and ski exercise can be performed in the absence of contact of the user with a fixed pad.

In one embodiment, the arms operate or grasp ropes, levers or the like which are coupled to preferably independent one-way clutch mechanisms so as to be independent in a bilateral fashion. In one embodiment, two independent ropes are wrapped around a one-way clutch coupled directly to the drive mechanism for the legs such as the flywheel shaft described above. The pulley system can be used to adjust the height at which the rope ends are positioned for grasping by the user in order to appropriately simulate cross-country ski poling. By coupling the arm-exercise devices to the same device used for leg motion resistance, the user encounters kinetic or dynamic resistance such that, at the start of each arm stroke, a moving resistance is encountered (i.e., the flywheel is already in motion) and there is no need to, e.g. overcome a coefficient of static friction. Further, by using both the legs and the arms to drive the same resistance mechanism, arm motion and leg motion are related such that more aggressive arm effort permits less aggressive leg exertion while maintaining a given level of effort.

In one embodiment, flywheel speed is regulated by a friction strap whose tightness or pressure against the flywheel changes depending on the position of the user with respect to the stationary exercise device. For example, in one embodiment, one end of the strap is coupled, e.g., via a line, to the user (such as being clipped to the user's clothing). As the user moves forward, pressure is released from the friction band until the flywheel begins spinning. Once the user has reached the desired speed, the system will automatically maintain that speed. If the user slows his or her pace, the user begins to drift back on the machine, resulting in pulling on the line and tightening the friction band, thus slowing the flywheel speed. As the user speeds up his or her pace, he or she moves forward on the machine, decreasing pressure on the friction band, and thus increasing the flywheel speed. Devices other than a cord and clothing clip can be used for determining the position of the user with respect to the stationary exercise machine, such as a sonar device. In another embodiment, a differential gear device or a differential motion pulley system adjusts a resistance mechanism (such as by tightening a friction belt on a flywheel) if the user's differential motion (i.e., average forward or backward ski motion) indicates the user is moving forward or rearward with resect to the machine. Thus, the user need not have any physical attachment via a cord or otherwise to the machine. Rather, the machine will sense whether the left/right alternating motion of the skis is resulting in a differential between forward and back motions such that the user is, on average, moving forward or backward with respect to the machine.

Rather than driving the flywheel only from the muscle power of the user, the flywheel may be driven by an electric motor, e.g., to overcome internal friction of the machine. The speed of the motor driving the flywheel is varied depending on the position of the user with respect to the machine (since, e.g., as described above, the machine will automatically adjust to the user's level of effort, as reflected by the user's position on the machine).

In one embodiment, hand grips are mounted on rails coupled to a resistance mechanism which can be used as an alternative to or in addition to the upper body resistance mechanism described above, e.g., to simulate stair climbing with banisters to provide the user, particularly an inexperienced user, with support or stability particularly when the device is used in an inclined configuration.

DETAILED DESCRIPTION OF THE PREFERRED EMBODIMENTS

Figure 1:
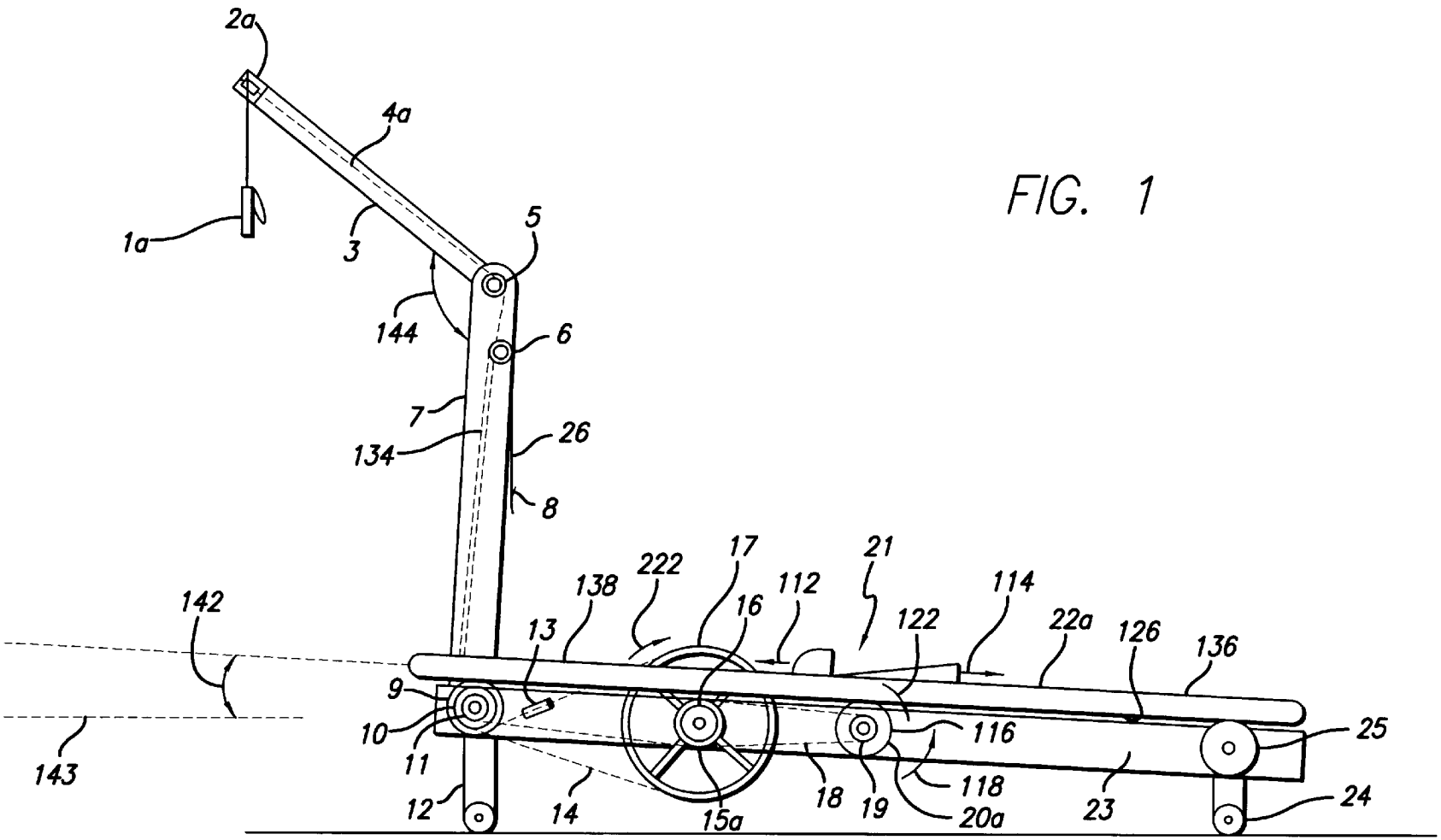
FIG. 1 depicts a side view of an apparatus according to one embodiment of the present invention.

As seen in FIG. 1, according to one embodiment, an exercise device includes a lower frame member 23 supported by front and rear frame supports 12, 24. The frame members, support members and the like can be made of a number of materials, including metal, such as steel or aluminum, plastic, fiberglass, wood, reinforced and/or composite materials, ceramics and the like. Preferably the frame supports 12, 24 are coupled to the lower frame such that the lower frame can be inclined 142 at various angles. For example, the incline of the machine can be adjusted by providing front supports 12 with various adjustment mechanisms such as a rack-and-pinion adjustment, hole-and-pin adjustment, ratchet adjustment, and the like. The machine can be operated at an inclination 142 within any of a range of angles, such as between about 0° and 45° (or more) to the horizontal 143, preferably between about 2° and about 30°. Preferably, in the embodiment of FIG. 1, at least some forward and upward inclination 142 is provided during use, e.g., sufficient to overcome internal friction of the device so as to position the user towards the rearmost position 136 while the user is not exercising.

Coupled to the frame on the left side thereof are front and rear idler wheels 9, 25, supporting a simulated ski 22 bearing a ski-type foot support 21, preferably having both toe and heel cups to permit the user to slide the simulated ski both in a forward direction and in a rearward direction against resistance, as described more fully below. The ski 22 can be made of a number of materials, including wood, fiberglass, metal, ceramic, resin, reinforced or composite materials. Preferably the ski 22 can be translated in a forward 112 or rear 114 direction while supported by idler wheels 9, 25. If desired, additional idler wheels can be provided and/or additional supports such as a low-friction support plate or rail, or a belt, cable, chain, or other device running between idler wheels 9, 25 can be used.

Figure 2:
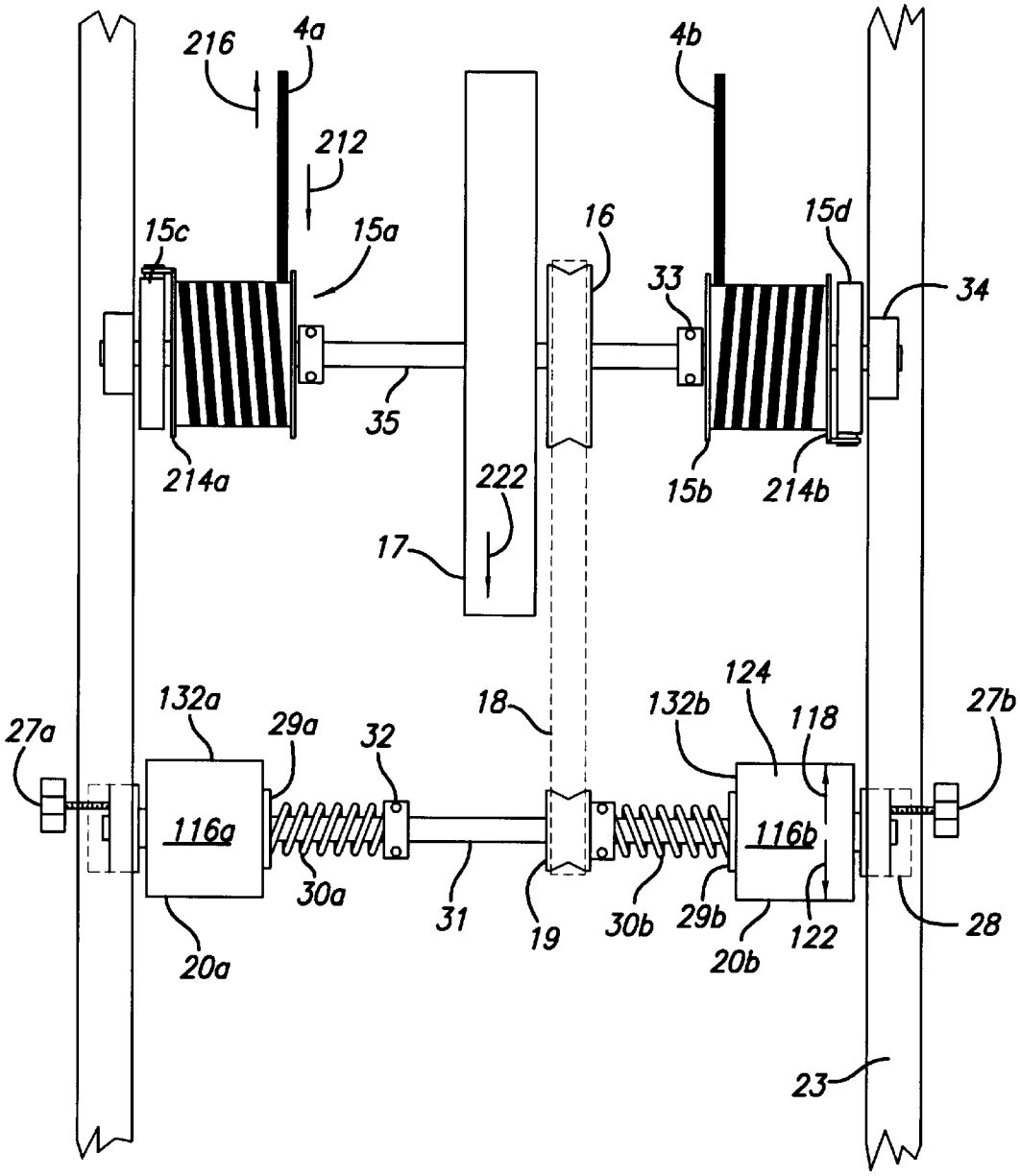
FIG. 2 is a top plan view (partial) of the apparatus of FIG. 1.

In the depicted embodiment the ski 22 is coupled to a roller 116 such that translation of the ski 22 in a forward direction 112 rotates the roller 116 in a first direction 118, and translation of the ski 22 in the opposite direction 114 rotates roller 116 in the opposite direction 122. Coupling to achieve such driven rotation of the roller 116 can be achieved in a number of fashions. For example, the roller's exterior cylindrical surface 124 and the bottom surface 126 of the ski 22 may be provided with high friction coatings. Teeth may be provided on the surfaces of the ski 22 and the roller 116 to drive the roller in a rack-and-pinion-like fashion. Ski 22 maybe coupled to a line wrapped about the roller 116. Although in the view of FIG. 1, only a single (left) set of idler rollers 9,25, driven roller 116 and ski 22 are depicted, a substantially identical set (not shown in FIG. 1) will be coupled on the opposite (right) side of the lower frame 23, some of which are shown in FIG. 2.

In the depicted embodiment, resistance to rearward movement 114 of the ski 22 is achieved by coupling the driven roller 116 so as to, in turn, drive a flywheel 17 which can be braked as described more fully below. As depicted in FIG. 2, in one embodiment the driven rollers 116*a*, 116*b* are the exterior surfaces of one-way clutches 20*a*, 20*b* configured such that when a ski 22*a* is moved in a rearward direction 114 so as to drive the exterior surface in a first rotational direction 122, the corresponding one-way clutch 20*a* will engage a driveshaft 31 causing the driveshaft 31 to also rotate in the first direction 122. However, when the ski 22*a* is moved in the forward direction 112, causing the exterior surface 124 to be moved in an opposite rotational direction 118, the corresponding one-way clutch 20*a* disengages so that the clutch overrides the driveshaft 31 and is essentially disengaged therefrom. The driveshaft 31 is rotationally mounted in driveshaft bearings 28 and shaft collars 32. A number of one-way clutch devices can be used, including a spring clutch, a plate clutch or a cam clutch. In one embodiment, a clutch of the type used in a Nordic Track™ exercise device (for a different purpose) is used. As seen in FIG. 2, each ski 22*a*, 22*b* is coupled to the same type of one-way clutch 20*a*, 20*b*, for selectively driving the driveshaft 31. Accordingly, the driveshaft 31 will be driven in a first rotational direction 122 whenever either the left ski 22*b* or the right ski 22*a* drives the left driven roller 116*a* or the driven roller 116*b* in the rearward rotational direction 122.

In the depicted embodiment, the driveshaft 31 is coupled to a second shaft 35 via V-belt 18, running around sheaves 19,16. Second shaft 35 is directly coupled to the flywheel 17. Thus, driving the driveshaft 31 results in rotation of the flywheel 17.

Because the flywheel, by virtue of its mass and effective radius (diameter) requires a substantial amount of energy to rotate, the flywheel, creates a certain amount of resistance to rotation of the driven rollers and thus, the translation of the skis 22*a*, 22*b*. Looked at in another way, and without wishing to be bound by any theory, it is believed the flywheel 17 resists the energy generated by the user in moving the skis rearwardly, causing the user's body to thrust forward. In the depicted embodiment, the speed of rotation of the flywheel can be controlled using mechanisms described more thoroughly below.

Preferably, resistance is also provided to rotation of the driven roller 116*a*, 116*b* in the opposite (forward) direction 118. Such resistance can be useful in more accurately simulating natural exercise, such as resistance to forward-sliding of cross-country skis through snow. In the depicted embodiment, brake pads 29*a*, 29*b* are urged against the inner faces of the one-way clutches 20*a*, 20*b*, e.g., by brake springs 30*a*, 30*b*. Preferably the brake pad 29 is coupled to the driveshaft 31 so as to rotate therewith. Accordingly, when a ski 22 is moved in the rearward direction 114 and the corresponding one-way clutch 20*a* is engaged with the driveshaft 31, the brake pad 29*a* rotates with the inner face 132*a* of the one-way clutch 20*a* so that substantially no friction braking of the one-way clutch 20*a* or driven roller 116*a* occurs. However, when the ski 22*a* is moved in the forward direction 112 so that the driven roller 116*a* is rotated in the forward rotational direction 118 and the one-way clutch is disengaged, the roller 116*a* and brake pad 29 are rotating in opposite directions 118, 122 respectively so that friction braking of the driven roller 116*a* occurs, providing frictional resistance to forward motion of the ski 22*a*.

In the depicted embodiment, a screw adjustment 27 is provided for adjusting the amount of friction (i.e., the pressure) of the brake pads 29*a*, 29*b* against the inner faces 132*a*, 132*b* of the rollers 116*a*, 116*b*. In the depicted embodiment, threaded adjust screws 27 are secured through the lower frame members 23 such that they press against the bearings 28. As the screws 27 are tightened, they force the bearings 28 to press against the clutches 20 which in turn press against the brake pads 29 and compress the springs 30 thereby increasing the intensity of the one-way friction.

Returning to FIG. 1, vertical frame member 7 and upper frame member 3 are preferably provided, extending upward and angularly outward with respect to the lower frame member 23. These frame members 7, 3 position upper arm exercise pulley 2*a*, 2*b* at a desired height such that the hand grips 1*a*, 1*b* can be grasped by a user for resisted pulling (as described below) to define a line of resistance (from the pulleys 2*a*, 2*b* to the user's hands) at a natural and comfortable height The pulley 2*a* may be positioned, e.g., approximately at the shoulder height of the user. In one embodiment, the height of the pulley 2*a* may be adjusted, e.g., by pivoting 144 the upper arm 3. In the depicted embodiment, the hand grip 1*a*, 1*b* are coupled to arm exercise lines 4*a*, 4*b* running over the upper arm exercise pulleys 2*a*, 2*b*, a second arm exercise pulley 5, a third arm exercise pulley 11, such that the opposite ends of the lines engage arm exercise one-way clutch drums 15*a*, 15*b*. As shown in FIG. 2, preferably each line 4*a*, 4*b* is wound, e.g., in helical fashion around the corresponding drum 15*a*, 15*b*. Preferably each drum 15*a*, 15*b* is provided with a recoil spring 15*c*, 15*d* such that when a user releases or relaxes the grip or tension on a line 4*a*, 4*b*, the drum 15*a*, 15*b* will rotate in a retract direction 212 to return the lines 4*a*, 4*b* to its coiled configuration: Each drum 15*a*, 15*b* is coupled to the second shaft 35 via a one-way clutch 214*a*, 214*b*. Preferably, the arm exercise one-way clutches 214*a*, 214*b* are substantially identical to the leg exercise one-way clutches 20*a*, 20*b*. The one-way clutch is configured so that when a line 4*a* is pulled by a user in a first direction 216, the one-way clutch 214*a* engages with the second shaft to drive the second shaft 35 in first rotational direction 222. When the line 4*a* moves in a second, retract direction 212 (under urging of return spring 15*c*), the one-way clutch 214*a* disengages from the shaft 35 and overruns the shaft. Thus, in the depicted embodiment, the lines 4*a*, 4*b* are coupled to the same resistance mechanism, namely the flywheel 17, as are the skis. The action of the arms and legs independently contribute to the momentum of the flywheel.

Returning to FIG. 1, a friction belt 14 is provided engaging at least a portion (such as about 75%) of the circumference of the flywheel 17. Preferably one end of the friction belt 14 is coupled to a spring 13 while the other end is coupled, via line 134, ranging over friction band pulley 10 and second friction band pulley 6, to a speed controller clothing clip 8. In one embodiment, an elastic line member such as an elastic "bungee" cord 26 couples the line 134 to the clip 8.

When the clip 8 is coupled to the user, such as by clipping to the user's belt or other clothing, net movement of the user backward 114 on the exercise machine relative to the frame 23 will result in tightening the friction band 14 on the flywheel 17 (in an amount dependent, at least partly, on the spring constant of the spring 13 and/or the effective spring constant of the elastic cord 26), thus slowing the rotation of the flywheel 17. As described above, the flywheel 17 is driven by the movement of the skis 22 and/or hand grips 1*a*, 1*b* in a one-way fashion, i.e., such that, in the absence of braking, moving the skis and hand grips faster tends to rotate the flywheel faster.

When the user is in the rearmost position of the machine 136, the friction band is at its tightest around the flywheel, preventing it entirely from spinning. As the user begins exercising and moves forward 112, pressure is released from the friction band and the flywheel begins spinning. Once the user has reached the speed desired by the user (i.e., the level of effort desired by the user), the user continues to exercise at this level and the system will automatically substantially maintain the corresponding speed of the flywheel. If the user slows his or her pace, the user will begin to drift back on the machine 114, under gravity power because of the machine incline 142, resulting in the tightening of the friction band 14 and the slowing of the flywheel speed. As the user speeds up his or her pace, he or she will move forward on the machine 112, decreasing the pressure on the friction band and thereby increasing the flywheel speed. Thus the system provides a method for speed control operated simply by the exerciser increasing or decreasing his or her level of effort. Thus there is no requirement for manual adjustments in order to change the intensity of the workout.

In practice, the user will mount the device, inserting his or her feet into the foot support 21 of the skis 22 and grasping the hand grips 1. The user will attach the clothing clip 8 to his or her clothing. Initially the user will be near the rear-most position 136 and the friction band 14 will be at its tightest. The user will move the skis in reciprocating fashion with a normal skiing motion and, because of the resistance mechanisms described above, the user will begin to move up 112 the incline 142 toward the front of the machine 138 and will cause the flywheel to begin rotating. Once the flywheel begins to spin, as the user's position fore and aft on the machine changes, there will be resultant constant variations in the machine friction band tension on the flywheel. As the user slows, the momentum of the flywheel will tend to propel him or her backward. However, as the user moves back, the friction band is tightened, as described above, and thus the flywheel begins to slow down until a balance is attained. As the user speeds up, the friction band is eased, and the flywheel is allowed to accelerate. This system will thus automatically vary the machine speed based on the user's position without the need to make manual adjustments or input. The user can, however, adjust the machine in a number of ways to affect the intensity of the exercise, if desired. The user may turn the adjusting knobs 27 to increase or decrease the forward resistance (e.g., to simulate varying friction conditions of snow). The user may change the incline of the machine 142 to increase or decrease the intensity of the exercise. If desired, the user will also pull on the ropes or hand grips 1*a*, 1*b* in the desired fashion for upper body resistance exercise. The user may pull on the ropes in an alternating fashion, parallel fashion, using either arm alone or the user may refrain from pulling on the ropes at all. As the user expends a greater level of effort (the sum of leg backward effort and any rope-pulling), the machine will automatically adjust the amount of friction on the flywheel 17 owing to the user's movement up or down the incline of the machine, depending on the user's level of effort.

Figure 3:
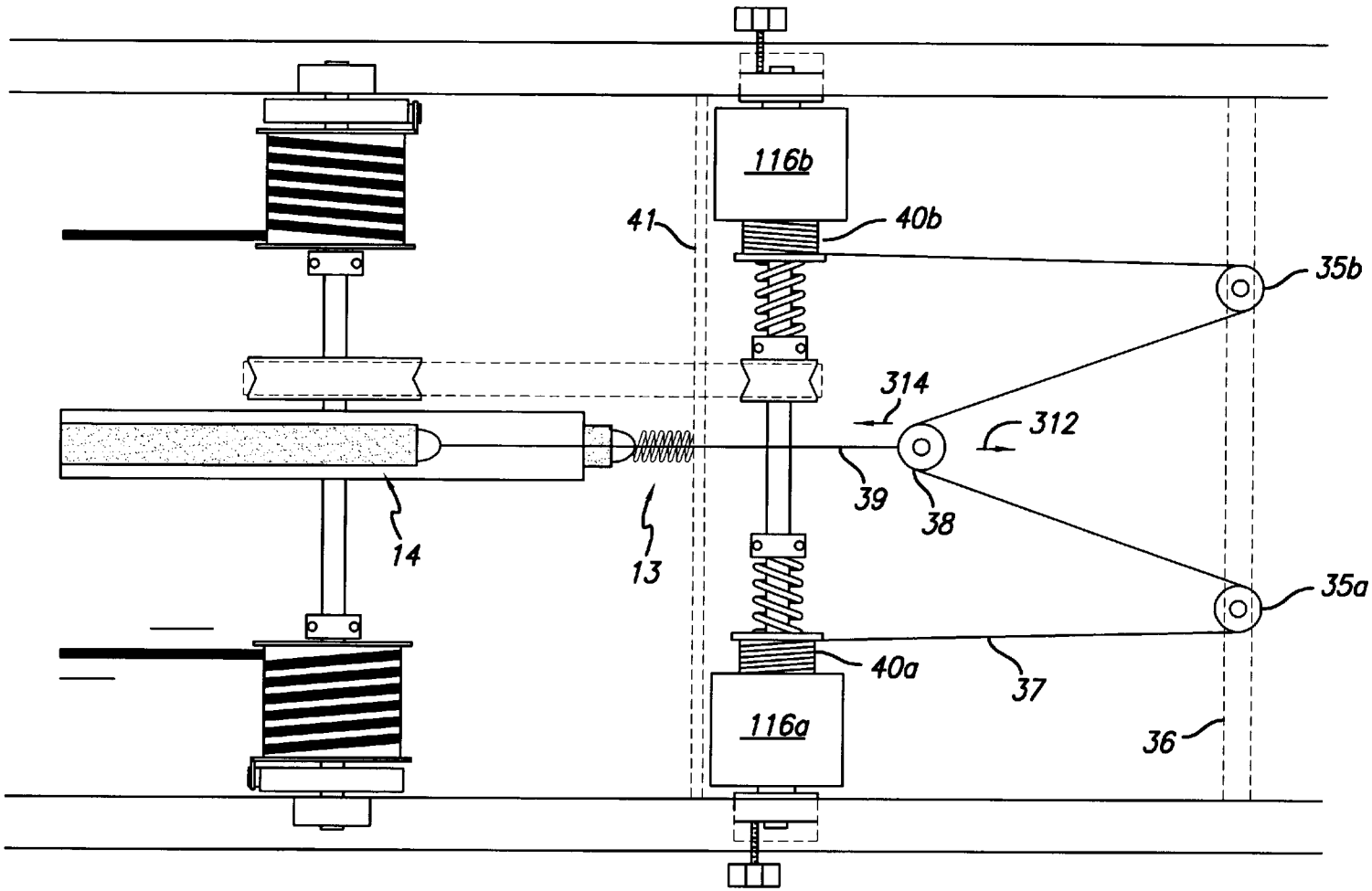
FIG. 3 is a top plan view similar to the view of FIG. 2 but showing a first alternate speed control mechanism.

A somewhat different speed control configuration is depicted in FIG. 3. In the embodiment of FIG. 3, there is no need for the friction strap 14 to be coupled via a line to the user's clothing. Instead, the depicted friction control is based on the fact that if a user moves upward (i.e., up the incline 142) toward the front of the machine 138, the machine, although each driven roller 116*a*, 116*b* will be alternatively driven in forward 118 and reverse 122 directions, there will be greater amount of forward rotation 118 than rearward rotation 122 as the user moves up the incline.

In the embodiment of FIG. 3, a line 37 is coupled between left and right rope spools 40*a*, 40*b* which rotate with the driven rollers 116*a*, 116*b*. Line 37 runs, in order, around a left fixed pulley 35*a*, a movable speed control pulley 38, and a right fixed pulley 35*b*. The amount of line 37 which, at any one time, is not wound on the spools 40*a*, 40*b* (i.e. the amount between the spools 40*a*, 40*b* and running around pulleys 35*a*, 38, 35*b*) will be referred to as the free line. If a user is maintaining his or her level of effort and thus staying at an average fixed location on the incline, as the user reciprocates the skis left and right, the rope 37 will move from one spool to the other, with no net movement of the movable pulley 38. Furthermore, as the user moves the left ski 22*a* backward and the right ski 22*b* forward an equal amount, the line 37 will unspool from the left spool 40*a*, and spool a substantially equal amount onto the right spool 40*b*. When the user in the reciprocating motion moves the right ski 22*b* backward, the same amount of line 37 will spool off the right spool 40*b* and onto the left spool 40*a*. However, as the user expends a greater amount of energy, the user will move up the incline and thus on average, the forward strokes of the skis will be longer than the rearward strokes. This will result in the same amount of line 37 being unspooled from the spools 40*a*, 40*b*, causing the effective free line length from the left spool 40*a* to right spool 40*b* (not considering the amount of line on the spools) to lengthen. As the effective length of the line lengthens, the movable pulley 38 is pulled forward 314, under urging of spring 13 which relaxes somewhat causing the line 39 to pull less tightly on the friction band 14, decreasing friction on the flywheel 17. As a result, as the user moves upward up the incline, the friction band 14 will loosen. As the user moves down the incline toward the rearmost position 136, the amount of free line will shorten, moving free pulley 38 rearwardly 312 and causing the friction band 14 to tighten.

Figure 4:
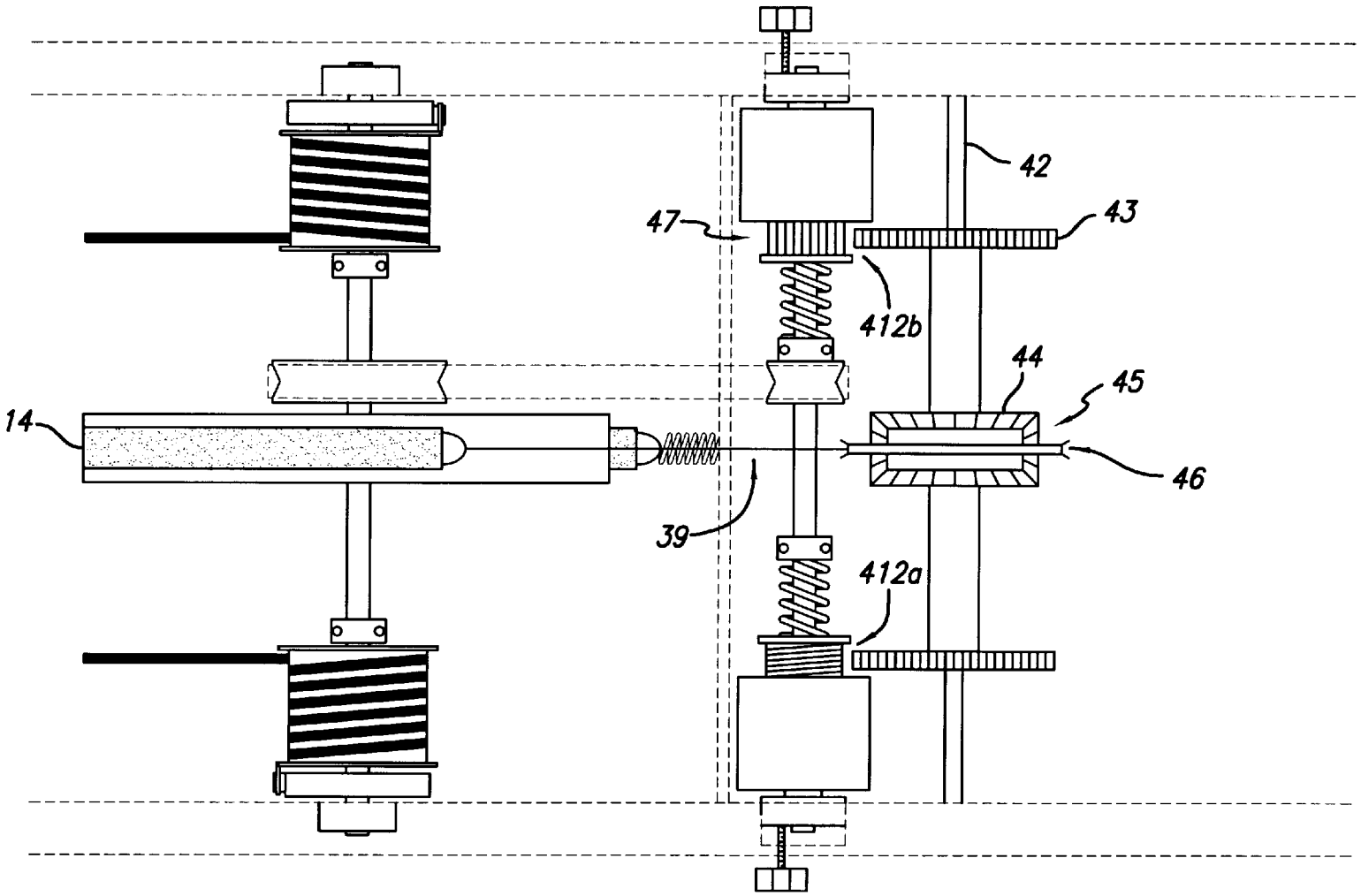
FIG. 4 is a top plan view similar to the view of FIG. 2 but showing a second alternate speed control mechanism.

FIG. 4 depicts another embodiment which uses a series of miter gears 44, 45 formed in a fashion similar to an automobile differential gear. With the differential gears of an automobile, (including those found in some toy automobiles) considering a car with wheels off the ground, spinning a wheel in one direction with the driveshaft locked results in the other wheel spinning in the opposite direction. Unlocking the driveshaft, as long as one wheel spins an amount equal and opposite to the other, the driveshaft remains unchanged. If both wheels spin a net amount in the same direction, the driveshaft will rotate.

In FIG. 4, a first set of drive gears 47 are attached to the rollers 116*a*, 116*b*. These engage a second set of drive gears 43 which are connected to a set of first miter gears 44 freely riding on a gearshaft 42. A set of second miter gears 45 are mounted between the first miter gears 44 and encircled by a friction band cord spool 46. A friction band cord 39 wraps around the spool 46 and attaches to the friction band 14. When one ski goes forward and the other goes back an equal amount, the opposite spinning first miter gears 44 counter each other in an equal and opposite manner. Since skiing is an alternating activity, the gearshaft 42 driven via gear trains 412*a*, 412*b* will remain relatively still while a user is skiing in one position on the machine, i.e. moving the skis substantially the same amount forward as backward). As a result the friction band cord spool 46 remains unchanged. If the user's average position moves fore or aft on the machine, the gearshaft 42 will turn in one direction or the other. Thus, as the user moves forward or backward on the machine, the gear shaft 42 will rotate forward or backward, via the differential or miter gears 44, 45, to rotate the friction band cord spool 46, causing line 39 to loosen or tighten so as to loosen or tighten the friction band 14. As will be clear to those of skill in the art, a number of differential gear devices can be used for this purpose.

Figure 5:
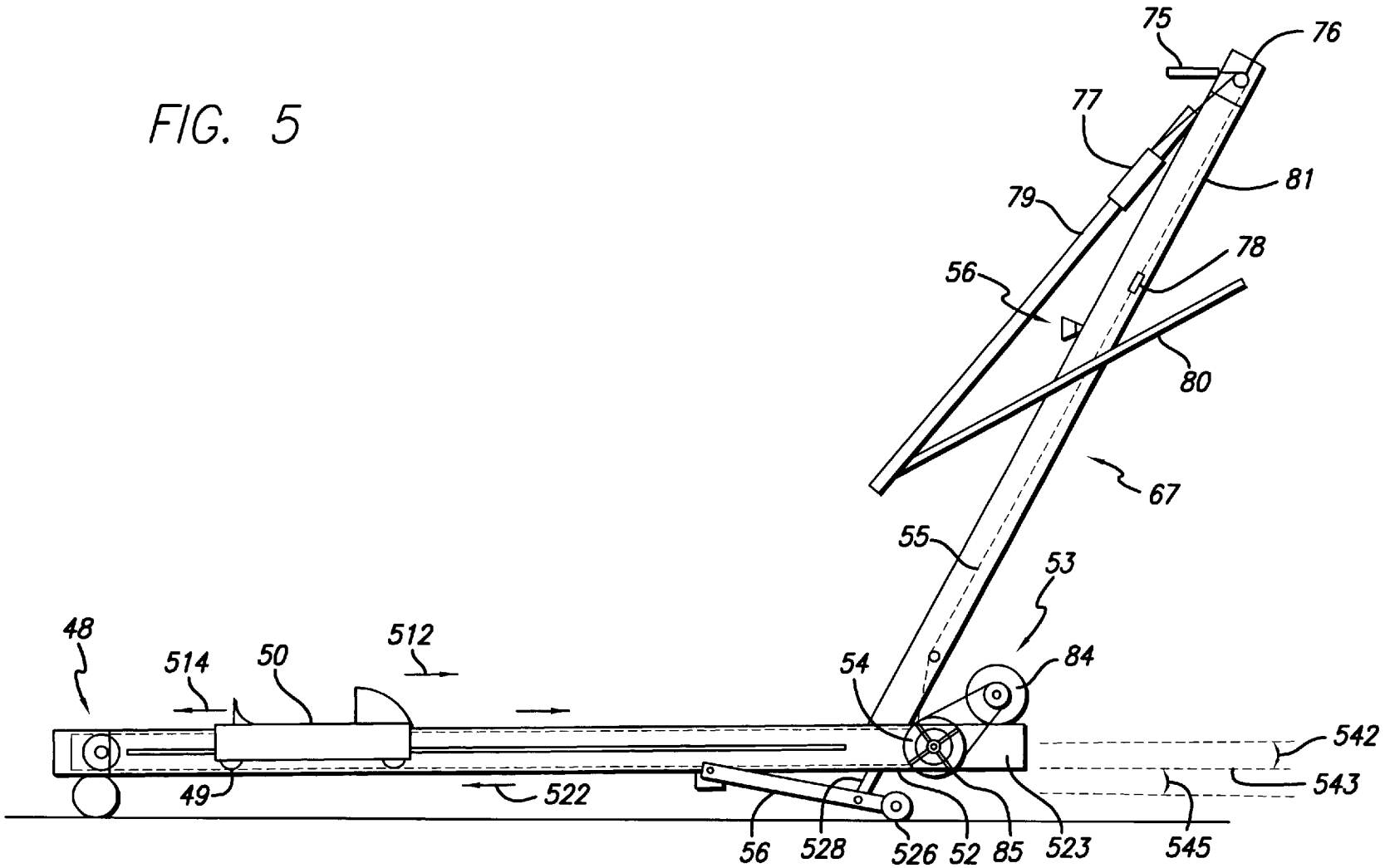
FIG. 5 is a side elevational view of an exercise apparatus according to an embodiment of the present invention.

FIG. 5 depicts an embodiment showing a number of alternative configurations. In the embodiment of FIG. 5, the user's feet, rather than being used to drive a simulated ski, instead drive a footcar 50 forward and back. The footcar 50 has wheels 49 with one-way clutches such that the footcar 50 is free to move in the forward direction (i.e., the wheel clutches are disengaged). When a footcar 50 is moved in the rearward direction, the wheels frictionally engage the inside of the surface of the conveyer belt 52 (i.e., the wheels are locked as footcar 50 is moved in the rearward direction).

FIG. 5 also depicts another method for controlling speed by driving a flywheel shaft with a motor. Using this method negates the need to incline the machine, as the motor overcomes any internal friction. The speed of the motor can be set manually such as on a treadmill or the speed potentiometer can be tied to one of the speed controllers described above such that the machine speed is dependent on the user's position on the machine.

In the embodiment of FIG. 5, during backward motion 514 of the footcar 50, while the footcar wheels 49 are locked, the amount of resistance to the backward motion of a given footcar perceived by the user will depend principally on the amount of forward friction on the opposing footcar and the inclination 542 of the exerciser with respect to the horizontal 543.

Without wishing to be bound by any theory, it is believed that when an exerciser is exercising on a device according to the present invention, and if there is no net or average fore-aft movement (i.e., the exerciser is substantially maintaining his or her fore-aft position) the amount of resistance to a backward leg thrust is equal to the amount of resistance to forward movement of the opposite leg. It is believed that when the device is inclined, the resistance to forward movement has a contribution both from the one-way friction brake described above and resistance to movement up the incline, against gravity. During use of the device, the speed of rearward leg movement (ignoring arm exercise, for the moment) will be regulated by the speed of rotation of the flywheel which will be moving at a substantially constant speed if the user is maintaining his or her fore-aft position on the machine. It is believed that the friction band, when it is applied as described to selectively slow the flywheel, is operating so as to balance the effect of gravity when the machine is inclined, in the sense that, if there were no friction band or other selective flywheel speed control, the user would tend to slide backward toward the rear-most position on the machine when the machine is inclined. It is believed that, in situations where a user moves forward or aft on the machine, there is a temporary small difference between the forward resistance and the rearward resistance.

As noted above, during bilateral motion using the exercise device of FIG. 5, the user will tend to oscillate somewhat forward and backward (even if the user is maintaining a constant average fore-aft position with respect to the exercise machine), as the user pushes back on each leg alternately. If the machine is inclined such that the track along which the footcars move is tilted upwards 542, with each forward oscillation, the user is also lifting his or her center of gravity a certain amount. The amount that the user lists his or her center of gravity on each stride will depend not only on the length of the stride but also on the amount of inclination 542. According to one embodiment, the exercise machine can be adjusted to affect the perceived difficulty or level of activity by increasing or decreasing the inclination.

Figure 5A:
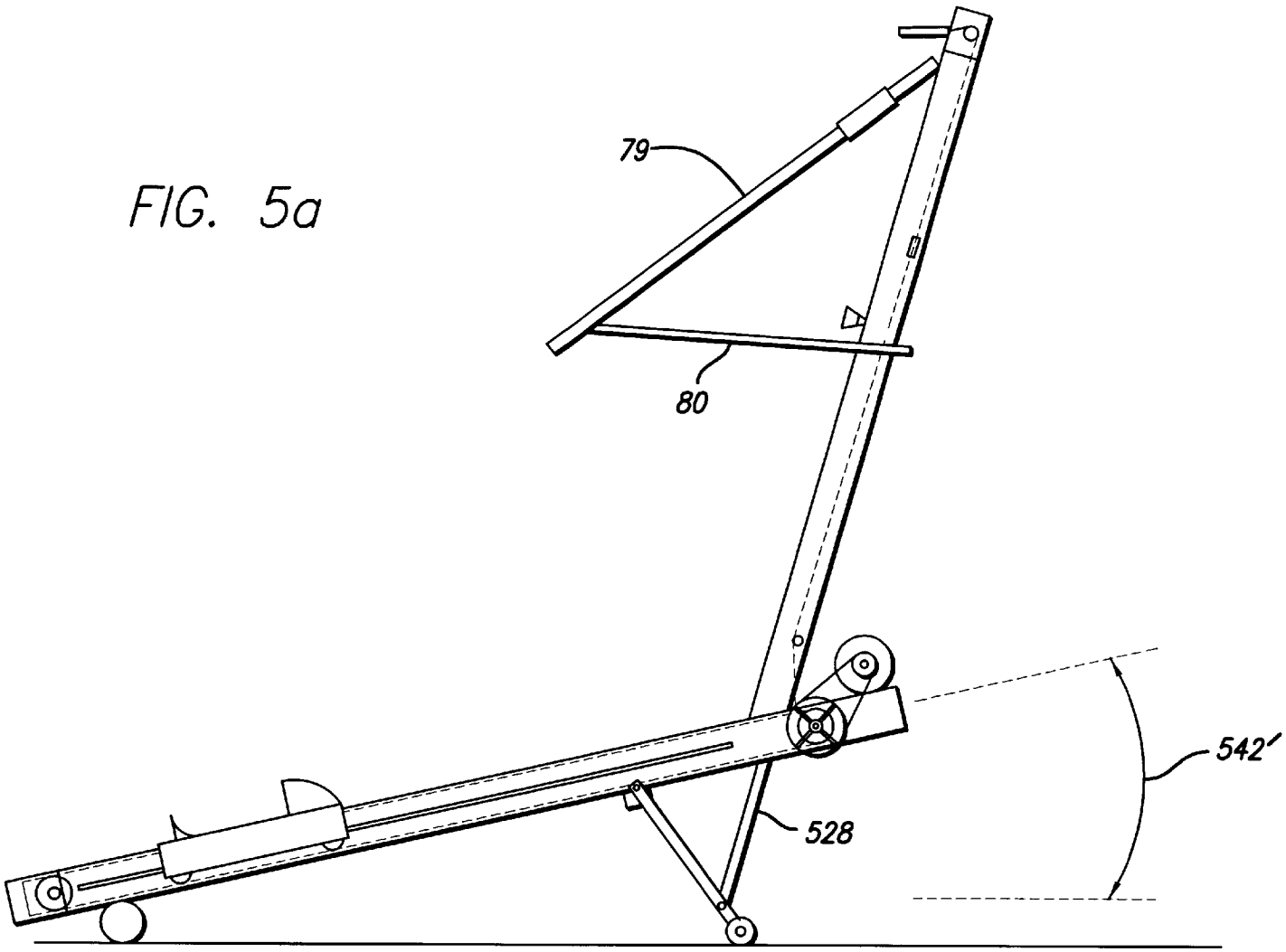
FIG. 5A is a side elevational view of the device of FIG. 5, but showing the device configured for increased inclination and with the arm rails extended.

In the depicted embodiment, the forward feet 526 are coupled to the lower frame 523 by a pivot arm 66. The pivot arm 66 can be held in any of the variety of pivot locations by adjusting the extension of link arm 528. Thus, if the user wishes to increase the inclination 542 to an inclination greater than that depicted in FIG. 5, the user may disengage the far end (not shown) of link arm 528, which may be engaged by a plurality of mechanisms including bar and hook, pin and hole, rack and pinion, latching, ratcheting or other holding mechanisms, and extend the link arm 528, e.g., to the position depicted in FIG. 5A to increase the inclination of the machine to a higher value 542', and resecure the far end of link arm 528 as depicted in FIG. 5A. If desired, the apparatus at FIG. 5 can be adjusted so that the footcars 50 move along a track which is angled downward toward the front of the machine (to simulate declined skiing situations).

When the device of FIG. 5 is set at an inclination 542 up to about 10°, it is anticipated that users will typically employ the arm ropes 75. At inclinations greater than about 10°, it is anticipated that users may prefer to use the rail system 77, 79. The rail system is believed to offer an upper body exercise similar to using a pair of banisters when climbing stairs.

As discussed above in connection with FIGS. 1 through 4, a variety of mechanisms can be used to sense the position and/or movement of the user along the fore-aft axis of the machine and to control speed, in response. In the embodiment of FIG. 5, similar devices can be used for sensing fore-aft position of the exerciser. In the embodiment of FIG. 5, it is preferred to use the position of the user to control the speed with which the belt 52 moves, e.g., by controlling the speed of the motor 53. For example, the speed of the motor 53 may be controlled by a motor speed potentiometer whose setting is determined by an arm coupled to a line or cable. Thus, whereas in the embodiments of FIGS. 1 through 4, pulling on a line 34, 39 resulted in tightening a friction band 14, in the embodiment of FIG. 5, pulling on a similar line in response to the fore-aft position of the exerciser moves a potentiometer arm so as to change the motor speed 53. Thus, as the user moves forward on the machine of FIG. 5, the potentiometer is preferably moved so as to increase the speed of the motor 53, and when the user moves backward, towards the rear of the machine, the potentiometer is moved to a position so as to decrease the speed of the belt 52. In the embodiment depicted in FIG. 5, rather than sensing the position of the user via a clothing clip or differential motion sensor, a sonar transducer is mounted to the upright frame 67 preferably at a height approximately near the user's abdomen to measure his or her distance from the front of the machine. In one embodiment, a microcontroller is used to operate the motor speed based on inputs from the transducer, e.g., according to the scheme depicted in FIG. 10, discussed more thoroughly below. A number of sonic transducers can be used for this purpose, including model part #617810 available from Polaroid.

Figure 6:
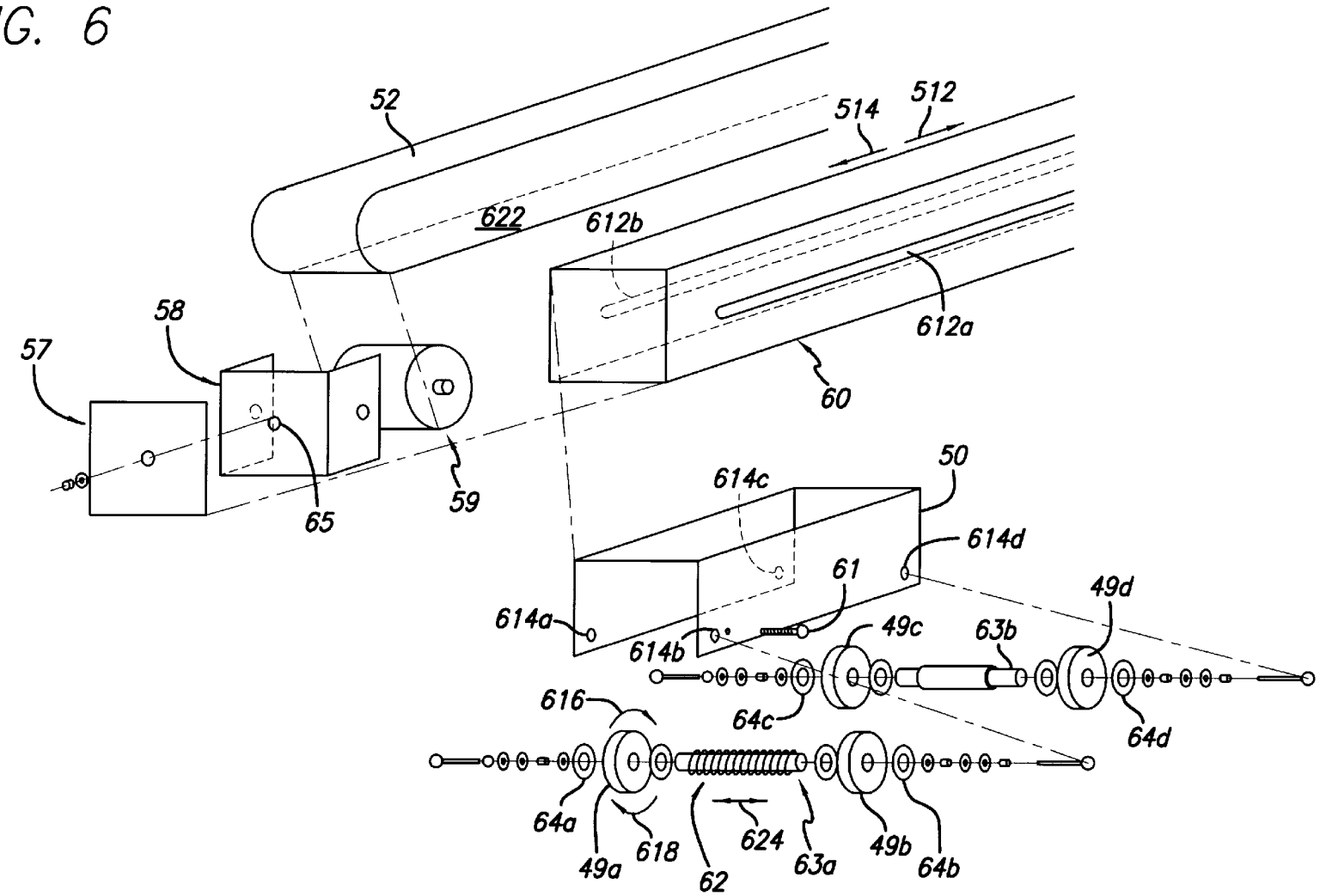
FIG. 6 is a partial exploded perspective view of a footcar and conveyor belt according to an embodiment of the present invention.

As depicted in FIG. 6, the footcar 50 has a generally inverted U-shape configured to fit over the top of a rectangular tube section 60. The rectangular tube section 60 includes longitudinal slots 612*a*, 612*b* which accommodate the axles 63*a*, 63*b* of the footcar. The axles 63*a*, 63*b* extend through the footcar axle bearings 614*a*, 614*b*, 614*c*, 614*d* and through the slots 612*a*, 612*b* as the footcar 50 moves forward 512 and aft 514 over the square tube 60. Interior to both the footcar 50 and the square tube 60, the axles 63*a*, 63*b* bear footcar wheels 49*a*, 49*b*, 49*c*, 49*d*. Each of the wheels 49*a*, 49*b*, 49*c*, 49*d* are configured with a one-way clutch, as described above, such that the wheels 49*a*, 49*b*, 49*c*, 49*d* roll freely in a first direction 616 but are locked against rotation in the opposite direction 618, when the footcar 50 is moving aft 514. A conveyor belt 52 is positioned in the interior of the square tube 60 with the bottom surfaces of the footcar wheels 49*a*, 49*b*, 49*c*, 49*d* contacting the inner surface 622 of the lower limb of the conveyor belt 52. The rear end of the conveyor belt 52 is retained by conveyor belt idler 59 held by an idler retainer 58 and backer plate 57. An adjustable screw 65 can adjust the fore-aft position of the idler retainer 58 to adjust the tension on the belt 52. The fore end of the belt 52 passes around the conveyor belt drive roller 70 (FIG. 7) which is mounted on a drive shaft 83. Preferably the footcars 50 are configured to provide adjustable resistance when moving in the forward 512 direction (independently of the amount of perceived resistance in the reverse direction).

In the embodiment described above in connection with FIGS. 1 through 4, it was described how it was possible to construct one-way forward leg resistance in connection with the one-way clutches 20*a*, 20*b*. In the embodiment of FIGS. 5 and 6, it is also preferable to provide an amount of forward leg resistance and, if desired, a mechanism similar to that discussed above in connection with FIGS. 1 through 4 can be used. In the embodiment of FIG. 6, friction pads 64*a*, 64*b*, 64*c*, 64*d* can be made to bear against the outside surfaces of the wheels 49*a*, 49*b*, 49*c*, 49*d*. In the depicted embodiment, the wheels 49*a*, 49*b*, 49*c*, 49*d* are free to move laterally 624 a certain amount. Thus, in one embodiment, when adjusting screw 61 is tightened, this screw presses against the outside of the friction pad 64*b* which in turn presses against the outside surface of the wheel 49*b*. A brake spring 62 pressing against the opposite side of the clutch 49 is provided to give increasing pressure against the tightening of the adjust screw 61, resulting in greater friction to the clutch in the free wheel direction 616.

Figure 11:
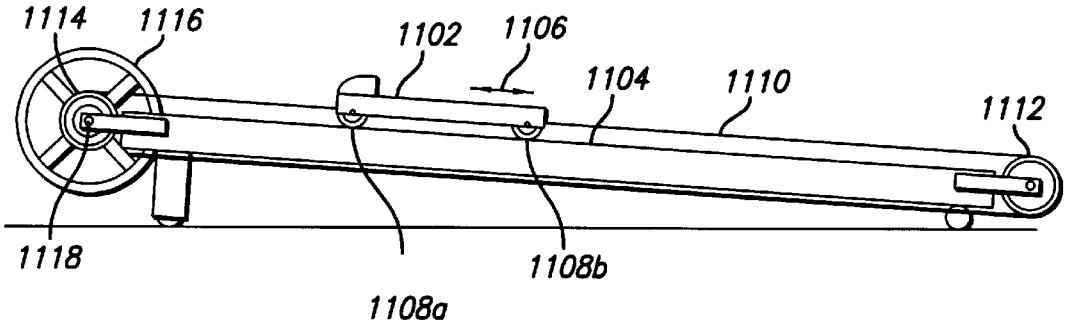
FIGS. 11 and 12 are side and partial top views illustrating an exercise device according to an embodiment of the present invention.
Figure 12:
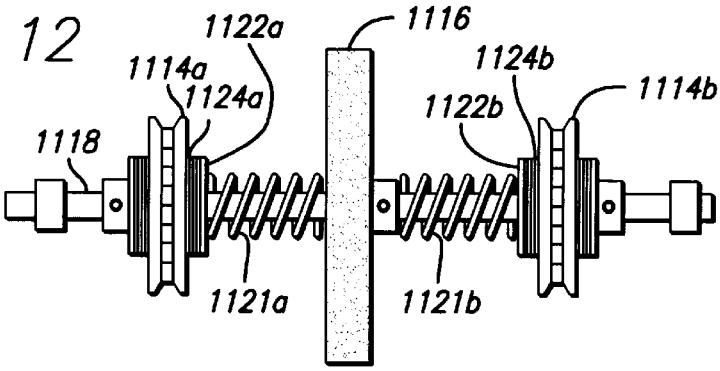

Another embodiment is depicted in FIGS. 11 and 12. A pair of slidable footcars (of which only the left footcar 1102 is seen in the view of FIG. 11) is mounted on parallel tracks (of which only the upper surface of the left track 1104 is seen in the view of FIG. 11). Although the tracks can be configured to provide a constant separation, such as a separation of about 12 inches (about 30 cm), the apparatus can also be configured to provide adjustable separation, e.g. via a rack and pinion mounting (not shown). The tracks are long enough to accommodate the full stride of the user, normally about 30 inches to 50 inches (about 75 cm to 125 cm).

The cars 1102 are designed to slide or travel linearly up and down 1106 the tracks. In the depicted embodiment, the cars travel on the tracks 1104 supported by wheels 1108*a,b* which are configured to maintain low rolling resistance to the tracks while carrying the full weight of the user.

A cable or belt 1110 attaches to the back of each car 1102 and extends in a loop over rear pulley 1112 and front pulley with integral one-way locking mechanism 1114, to attach to the front of the car 1102. The integral one-way locking mechanism of the front pulley can be, for example, similar to that used for the one-way clutches 20*a,b* of the embodiment of FIG. 2. In the depicted embodiment, the front pulley 1114 and a speed controlled flywheel 1116 or motor (not shown) are mounted on (or coupled to) a common drive axle 1118. The flywheel may be mounted on the drive axle in a fashion similar to that described for mounting a flywheel on shaft 35 in the embodiment of FIG. 2. Preferably, the cable or belt is designed to grip the front pulley 1114 such that there is little or no slippage between the cable 1110 and the pulley 1114, even under load. In one configuration, the belt 1110 is a geared belt of the type used for a timing belt (e.g. a nylon belt) with mating cogs being provided on the forward pulley 1114.

As depicted in FIG. 12, each forward pulley 1114*a,b* is configured with a one-way friction mechanism 1124*a,b*. The one-way locking mechanism and one-way friction mechanism are configured such that when a car 1102 is moved in rearward direction, the locking mechanism 1124 engages and spins the drive axle 1118, driving the flywheel 1116. When a car 1102 is moved in the forward direction, the one-way locking mechanism 1124 releases and the one-way friction mechanism 1122 causes a rearward force on the car 1102 transferred from the momentum of the moving flywheel 1116 or motor force. The intensity of the one-way friction mechanism 1122 can be made adjustable (such as by adjusting the force of springs 1121*a,b* and, thus, washers 1122*a,b* on the friction pads 1124*a,b*) or kept at a fixed level. The inclination of the tracks can be varied, as described for other embodiments herein. Arm exercise mechanisms can be coupled to the drive shaft as described for other embodiments herein.

Figure 7:
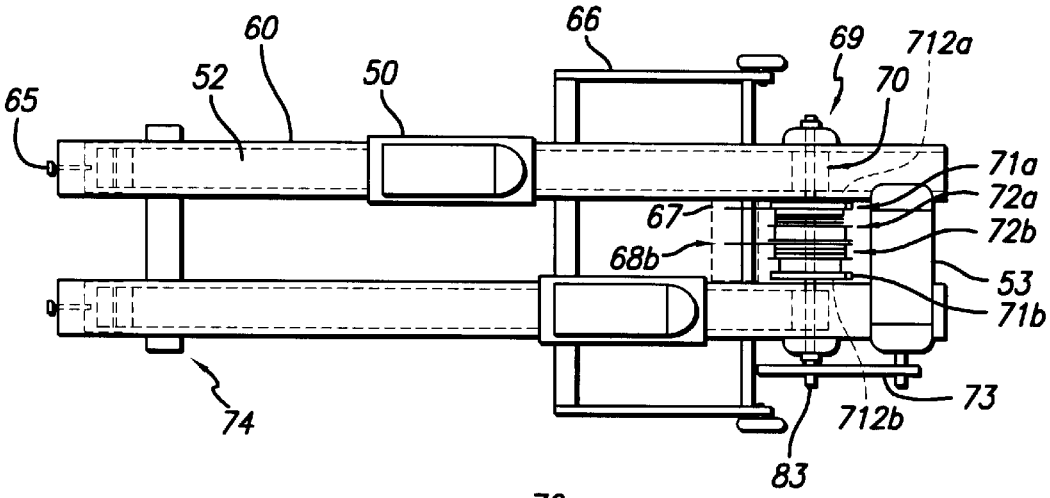
FIG. 7 is a top plan view, with upright frame elements removed, of an exercise device according to an embodiment of the present invention.
Figure 8:
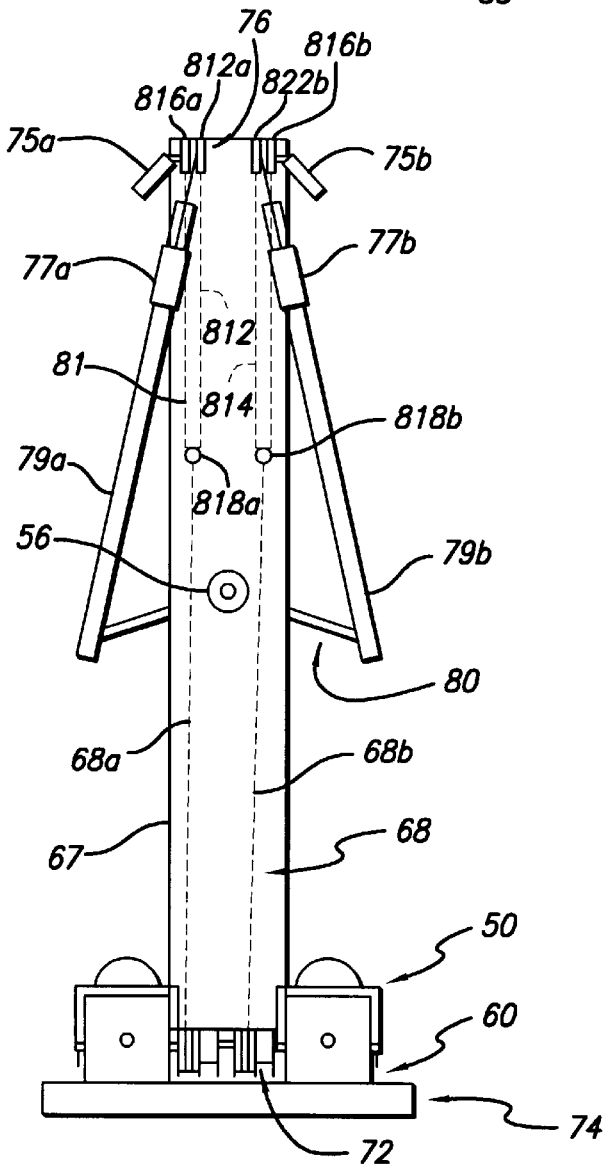
FIG. 8 is a rear elevational view of an exercise device according to an embodiment of the present invention.
Figure 9:
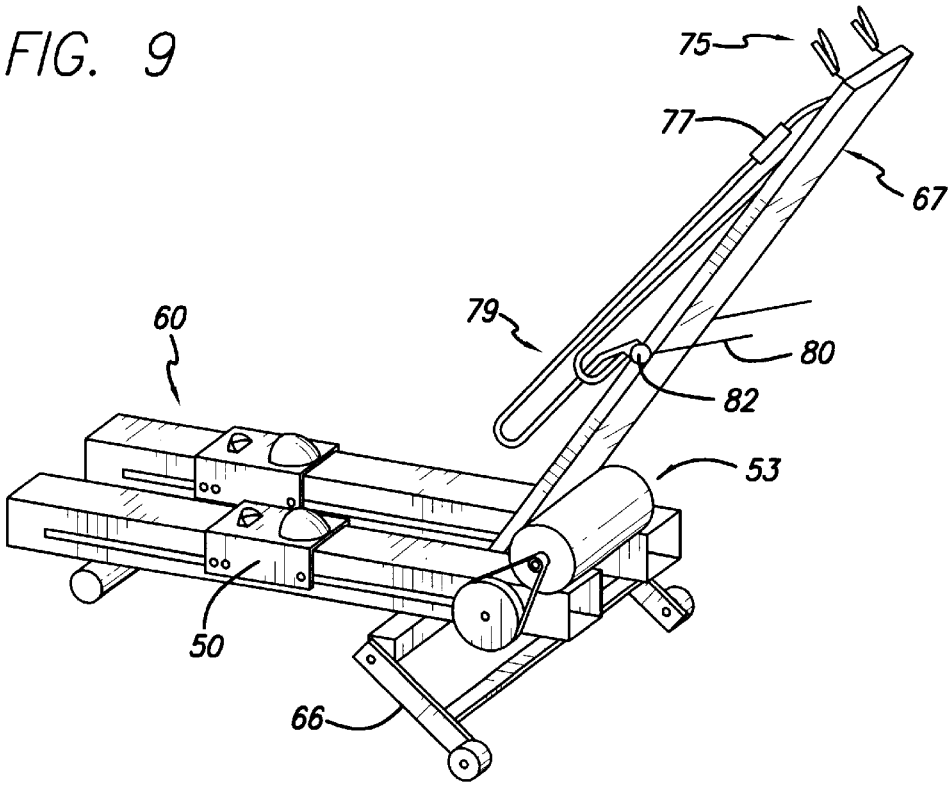
FIG. 9 is a perspective view of an exercise device according to an embodiment of the present invention.

FIGS. 7 through 9 also depict an arm exercise mechanism. In the depicted embodiment, an upright frame element 67 accommodates left and right ropes 812, 814. A first end of rope 812 is coupled to a left hand grip 75*a*. The rope 812 then is positioned over a first fixed pulley 816*a*, over a second movable pulley 818*a*, (coupled to arm line 68*a*) to a second fixed pulley 822*a* and thence coupled to a rail hand grip 77*a* configured to slide along rail 79*a*. As can be seen in FIG. 8, a similar arrangement is provided for the right rope 814. If the machine is declined 545, it is anticipated that the user will typically use the hand grips 75*a*, 75*b* rather than the rail grips 77*a*, 77*b*.

The arm exercise lines 68*a*, 68*b* are wrapped around spools 72*a*, 72*b* coupled by one-way clutches 712*a* 712*b* to the driveshaft 83. A number of one-way clutches can be used for this purpose, including clutches similar to those 20*a*, 20*b* used in connection with the driven rollers 116*a*, 116*b*. The spools 72*a*, 72*b* are coupled by the clutches 712*a*, 712*b* to the driveshaft 83 in such a manner that unwinding either of the ropes 68*a*, 68*b* by pulling on the hand grips 75*a*, 75*b*, 77*a*, will cause the clutch to engage and lock against the shaft 83 in the same direction that the shaft is spinning the belt drive rollers 70. A pair of recoil springs 71*a*, 71*b* retract the ropes 68*a*, 68*b* onto the spools 71*a*, 71*b* when the user relaxes tension on the ropes 68*a*, 68*b*.

By pulling on either end of the ropes 812, 814, i.e., by pulling on hand grips 75*a*, 75*b* or rail grips 77*a*, 77*b*, the movable pulleys 818*a*, 818*b* are, respectively, pulled upward, unspooling lines 68*a*, 68*b* from the spool 72*a*, 72*b* such that the user perceives resistance to pulling on the handle 75,77 (greater than internal or friction resistance) if the speed of pulling is such that the spools 72*a*, 72*b* are rotating at a rotational rate faster than that of the current rotational rate of the shaft 83. The linear speed of the rope ends 75*a*, 75*b*, 77*a*, 77*b* is related to rotational rate of the spools 72*a*, 72*b* by the spool diameter. In the depicted embodiment, the spools 72*a*, 72*b* are each provided with two separate stepped diameters. Thus, the user may, if desired, adjust the ratio of arm resistance to leg resistance by causing the lines 68*a*, 68*b* to be spooled onto or off of the smaller-diameter sections of the spools 72*a*, 72*b*. In one embodiment, this can be done by pulling each rope 68*a*, 68*b* until it is completely unwound from the spools 72*a*, 72*b* and rewrapping it under manual guidance, on a different portion of the spool with a different diameter. The same effect could be achieved using a bicycle-type derailleur to automatically shift the ropes from one diameter section to another. Although in the depicted embodiment only two diameters of spool are shown, three or more could be provided if desired, or a single diameter could be provided. It is also possible to couple the spools 72*a*, 72*b* to the driveshaft 83 via a linkage such as a chain drive, belt drive, gear train or the like, which could be provided with changeable transmissions for changing the effective ratio and thus the relative resistance to arm exercise.

In use, the exerciser can choose to manually control the motor speed, e.g., via a manual potentiometer knob or other adjustment, or can rely on the speed controller described above for automatic adjustment. The user steps onto the footcars 50 and, beginning at the rearmost position, typically, starts an alternating "walking" type motion. Initially, the conveyor belts are stopped and thus the wheels with the one way clutches on the foot cars allow the cars to slide forward but not backward. As a result, the user moves towards the front of the machine. As the user moves forward, the speed control circuit, as described above, causes the motor 53 to begin driving the belts. As the user approaches the front of the machine, the user may, if desired, grasp the hand grips 75*a*, 75*b* or 77*a*, 77*b*, preferably continuing the walking motion. As the motor begins to move the conveyor belts, the user's position is changed relative to the frame of the exerciser and the speed control circuit, described above, continually adjusts the speed of the conveyor belts to the user's stride.

Preferably the rails 79 can be pivoted so that they can be folded out of the way as depicted in FIG. 5 or extended as in depicted in FIG. 5A for use. To adjust the position of the rails 79 adjust knobs 82 (FIG. 9) are loosened to allow rail support 80 to slide freely. When the rails 79 are positioned in the desired location, the knobs 82 are tightened to hold the rails in the desired position.

Figure 10:
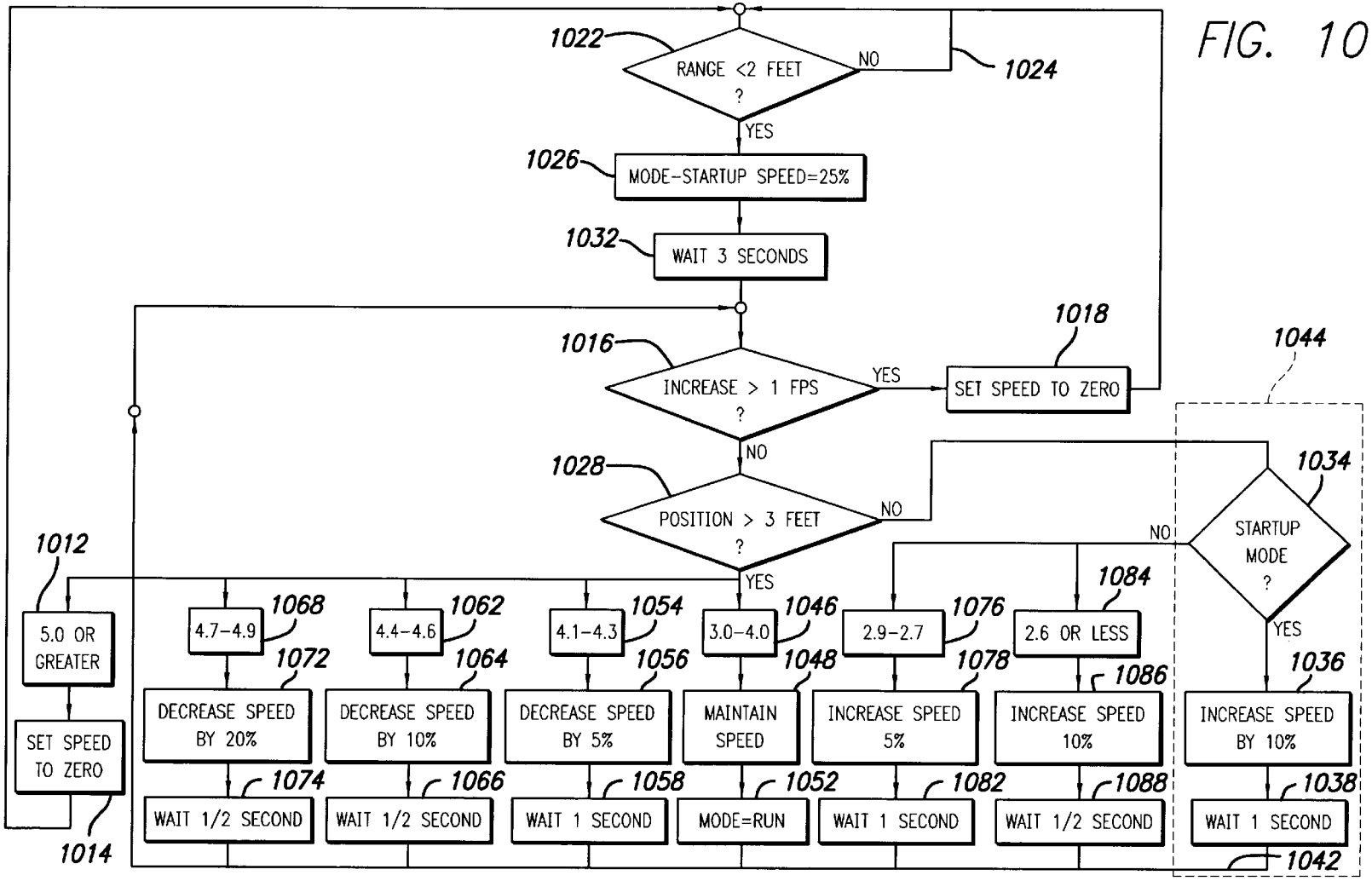
FIG. 10 is a flowchart depicting a procedure for speed control of an exercise device according to an embodiment of the present invention.

FIG. 10 depicts a procedure that can be used for adjusting the speed of motor 53. In one embodiment the procedure depicted in FIG. 10 is implemented using a microcontroller for controlling the motor. In the embodiment of FIG. 10, it is preferred that if the user is more than a predetermined distance aft (such as five feet or greater from the front of the machine) 1012, the belts 522 will be immobile, i.e., the motor speed will be set to zero 1014. Similarly, if at any time the distance of the user from the front of the machine changes at a rate of greater than one foot per second for greater than 1.5 feet 1016, the belts are similarly stopped by setting the motor speed to zero 1018. The procedure preferably differs somewhat depending on whether the machine is in start-up mode (e.g., after the user initially mounts the machine) or is in normal or run mode.

Preferably, the unit will not start unless the range (i.e., the distance of the user from the front of the machine) is less than a predetermined amount such as two feet 1022. If the user is not in this range, the procedure loops 1024 until the user moves within range. Once the user has moved within range, the machine is initially in start-up mode and the speed is set to a predetermined initial speed such as 25% of maximum speed 1026. In one embodiment, the controller will ramp up a speed gradually so that the output from the microcontroller board can go immediately to 25% upon start-up. Assuming the maximum velocity condition has not been exceeded 1016, if the range stays below three feet 1028 within three seconds 1032 while the device is in start-up mode 1034 the speed will increase by 10% 1036 each second 1038, looping 1042 through this start-up procedure 1044 until the user exceeds a range of three feet 1028. Once the user exceeds a range of three feet from the front of the machine 1028, i.e., is within the range of three feet to four feet 1046, the motor speed 53 will be maintained 1048 and the machine will thereafter be considered to be in run mode 1052.

In general, the speed of the machine will be maintained constant whenever the user is in a predetermined range such as three to four feet 1046. Once the device is out of start-up mode, in general, the procedure will decrease motor speed if the position exceeds four feet or increase motor speed if the range falls below three feet, (until such time as the user exceeds a predetermined maximum range 1012 or a predetermined speed 1016). In the depicted embodiment, if the range goes to 4.1 to 4.3 feet 1054 the speed will be decreased by five percent 1056 every second 1058 until the range is back to three to four feet 1046 at which point the present speed will be maintained 1048. If the range goes to 4.4 to 4.6 feet 1062 the speed will be decreased by 10 percent 1064 every half second 1066 until the range is back to three to four feet 1046. If the range goes to 4.7 to 4.9 feet 1068 the speed will be decreased by 20 percent 1072 every half second 1074 until the range is back to three to four feet. If the range exceeds five feet 1012, the motor speed will be set to zero 1014 and the unit will not start again until the range is less than two feet 1022. If the range goes to 2.9 to 2.7 feet 1076 the speed will be increased by five percent 1078 every second 1082 until the range is back to three to four feet. If the range goes to 2.6 feet or less 1084 the speed will be increased by 10 percent 1086 every half second 1088 until the range is back to three to four feet or full speed is attained, at which point present speed will be maintained. As will be clear to those of skill in the art, the number of categories of speed, the amount of increase in speed and the rate at which speed increments are added can all be varied. Additionally, it is possible to define motor speed as a continuous function of position, rather than as a discrete (stepwise) function. Other types of control can be used such as controls which automatically vary the speed at predetermined times, or in predetermined circumstances, e.g., to simulate different snow or terrain conditions, controls which automatically raise or lower the elevation 528, 542 to simulate variations in terrain and the like.

In light of the above description a number of advantages of the present invention can be seen. The present invention more accurately simulates natural exercise then many previous devices. In one embodiment the device provides resistance to forward or upward leg movement rather than only rearward leg movement. Preferably forward leg movement resistance can be adjusted. Preferably the device controls the speed and/or resistance offered or perceived and, in one embodiment speed is controlled in response to the fore-aft location of the user on the machine. In one embodiment, the fore-aft location is detected automatically and may, in some embodiments, be detected without physically connecting the user to the machine, e.g., by a clothing clip or otherwise. The device is capable of providing upper body exercise, preferably such that, as a user maintains a given level of overall effort, expenditure of greater lower body effort permits expenditure of less upper body effort and vice versa. Preferably the arm exercise is bilaterally independent such that user may exercise left and right arms alternately, in parallel, or may exercise only one or neither arm during leg exercise.

A number of variations and modifications of the present invention can be used. In general, the described method of speed control (preferably involving automatically adjusting speed or perceived resistance based on fore-aft position of the user, without the need for manual input or control) is applicable to exercise machines other than ski simulation machines, including treadmill or other running or walking machines, stair climbing simulators, bicycling simulators, rowing machines, climbing simulators, and the like.

Although FIG. 1 depicts a device inclined upward in the forward direction, it would be possible to provide a machine which could be inclined downward in the forward direction if desired, although this would remove the gravity-power aspect of the configuration.

Although embodiments are described in which speed control is provided by a braked flywheel, other speed control devices can also be used. The flywheel could be braked by a drum-type brake or a pressure plate- or pad-type brake in addition to the circumferential pressure belt brake. The driven roller 116 could be coupled to drive an electric generator for generating energy, e.g., to be dissipated with variable resistance. The flywheel 17 can be provided with fins, blades, or otherwise configured to be resisted by air resistance.

Although in FIG. 2, two shafts are depicted 31, 35, coupled by a belt 18, it would be possible to have the clutches 20*a*, 20*b* coupled directly to the flywheel shaft 31, or otherwise to provide only a single shaft. Although it is preferred to use the same resistance mechanism (e.g. flywheel 17) from arm and (backward) leg motion, it would be possible to provide separate resistance devices (such as two flywheels).

Although the embodiment of FIG. 5 depicts two separate treadmills, one for each footcar, it is possible to provide a configuration in which a single treadmill is provided extending across the width of the device. In situations where two treadmills are provided, it would be possible to configure the device such that the treadmills can move at different speeds (such as by driving each with a separate motor or providing reduction gearing for one or both treadmills), e.g., for rehabilitative exercise and the like.

In one embodiment, the inclination 542 can be changed automatically, e.g., by extending link arm 528 using a motor to drive a rack and pinion connection. Preferably, the motor is activated in response to manual user input or in response to a pre-programmed or pre-stored exercise routine such that the device can be elevated during exercise.

Although in the embodiment of FIG. 5 the speed of the belt movement was adjusted by adjusting the speed of the motor 53, it would also be possible to use a constant-speed motor 53 and employ, e.g., shiftable gears to change the belt speed. It is also possible to provide speed control which is configured to provide a constant speed, rather than a variable or adjustable speed.

Although it is recognized that there may be some amount of resistance to forward (or upward) leg movement arising from internal machine resistance and/or overcoming the effects of gravity, preferably the exercise device of the present invention can provide forward or upward leg movement resistance which is greater than internal machine resistance and/or gravity resistance and preferably is adjustable (which internal machine resistance and gravity resistance typically are not).

Although it is anticipated that users will typically perform leg exercise in an alternating, reciprocal fashion, preferably the exercise device does not force the user into this type of exercise. In the depicted embodiments, there is nothing in the machine that would prevent a user from moving one leg more vigorously than the other (or even keeping one leg stationary) although it might be necessary to adjust speed control to accommodate this type of.

Although the invention has been described by way of a preferred embodiment and certain variations and modifications, other variations and modifications can also be used, the invention being defined by the following claims:

What is claimed is:

1. An exercise device comprising:

a frame;

means for engaging a user to at least one follower;

means for translating at least a first follower in response to movement of at least a first limb of a user along an inclined path with respect to said frame;

variable speed means for resisting said translation of said follower with a first resistance related to the speed of said variable speed means; and means for controlling the speed of said variable speed means in response to the location of said user with respect to said frame, without the need for manual input by said user during exercise, wherein resistance is increased as said user moves down said incline and resistance is decreased as said user moves up said incline.

2. An exercise device comprising:

a left foot engager movable in forward and rearward directions;

a right foot engager movable, independently from said left foot engager, in forward and rearward directions;

a clutch mechanism which effectively couples at least said left foot engager to a first resistance at least during a first period when said left foot engager is being moved in a rearward direction;

a second resistance coupled to at least said right foot engager at least while said right foot engager is being moved in a forward direction during said first period;

wherein the magnitude of resistance to rearward movement of said left foot engager is substantially equal to the magnitude of resistance to forward movement of said right foot engager during said first period.

3. An exercise device comprising:

a left foot engager movable in forward and rearward directions;

a right foot engager movable, independently from said left foot engager, in forward and rearward directions;

a left one-way clutch mechanism which effectively couples at least said left foot engager to a flywheel at least during a first period when said left foot engager is being moved in a rearward direction;

a right one-way clutch mechanism which effectively couples at least said right foot engager to said flywheel at least during a second period when said right foot engager is being moved in a rearward direction;

a right friction brake rotating with said flywheel for selectively applying a braking force to said right one-way clutch mechanism at least while said right foot engager is being moved in a forward direction during said first period; and a left friction brake rotating with said flywheel for selectively applying a braking force to said left one-way clutch mechanism at least while said left foot engager is being moved in a forward direction during said second period.

4. An exercise device as claimed in claim 3 further comprising means for adjusting the magnitude of resistance to rotation of said flywheel.

5. An exercise device as claimed in claim 4 wherein said means for adjusting comprises a friction strap coupled to said flywheel.

6. An exercise device as claimed in claim 4 wherein said means for adjusting decreases resistance in response to net forward movement of said user.

7. An exercise device as claimed in claim 3 further comprising means for sensing net movement of said user fore or aft.

8. An exercise device as claimed in claim 7 wherein said means for sensing is selected from the group consisting of a line coupled to said user, a sonar sensor and a differential gear train.

9. An exercise device as claimed in claim 3 further comprising a motor for driving said flywheel.

10. An exercise device as claimed in claim 9 further comprising means for adjusting the speed of said flywheel in response to the position of said user fore or aft.

11. An exercise device as claimed in claim 3 wherein said left and right friction brakes are adjustably spring-mounted, respectively, adjacent said left and right one-way clutch mechanism to permit adjustment of the magnitude of resistance to forward movement of said left and right foot engagers.

12. An exercise device as claimed in claim 3 further comprising means for grasping by an exerciser, said means for grasping being coupled to said flywheel.

13. An exercise device as claimed in claim 12 wherein said means for grasping comprises first and second lines.

14. An exercise device as claimed in claim 13 wherein said first and second lines are coupled to said flywheel using first and second one-way clutches.

15. An exercise device as claimed in claim 12 further comprising means for adjusting an effective height of said means for grasping.

16. An exercise device as claimed in claim 3 further comprising first and second hand grips slidably coupled to first and second rails and means for resisting motion of said first and second hand grips.

17. An exercise device as claimed in claim 16 wherein said means for resisting comprises first and second lines coupled to said flywheel.

18. An exercise device as claimed in claim 17 wherein said first and second lines are coupled to said flywheel using first and second one-way clutches.

19. An exercise device as claimed in claim 16 further comprising means for adjusting effective heights of said first and second hand grips.

20. An exercise device as claimed in claim 3 further comprising means for adjusting inclination of movement of said left and right foot engagers.

21. An exercise device as claimed in claim 3 wherein a bottom surface of said left and right foot engagers directly drives an exterior surface of said left and right one-way clutches.

22. An exercise device as claimed in claim 3 wherein said left and right foot engagers comprise left and right foot cars having one-way clutched wheels for selectively engaging left and right belts.

23. An exercise device as claimed in claim 22 further comprising means for adjusting an amount of resistance to rotation of said wheels.

24. An exercise device as claimed in claim 3 wherein said left and right foot engagers comprise left and right foot cars coupled by left and right lines to a flywheel by left and right one-way clutches.

25. An exercise device as claimed in claim 3 further comprising means for transferring a rearward force from said flywheel to said left and right foot engagers when said left and right foot engagers are moving in a forward direction.

26. An exercise device as claimed in claim 25 further comprising means for adjusting the intensity of said rearward force.

27. A ski-exercise device for a user, comprising:

left and right foot engagers, each movable fore and aft along left and right tracks, respectively;

a resistance device coupled to said left and right foot engagers to provide controllable resistance to aft movement of said left and right foot engagers;

a resistance device coupled to said left and right foot engagers to provide resistance to forward movement of said left and right foot engagers equal to said resistance to aft movement, wherein said exercise device operates, providing said forward resistance equal to said aft resistance, throughout a range of inclinations, said range of inclinations including zero inclination.

28. A ski-exercise device as claimed in claim 27 wherein said resistance device to provide resistance to aft movement is the same device as the resistance device to provide resistance to forward movement.

29. A ski-exercise device as claimed in claim 27 wherein said resistance device to provide resistance to aft movement includes an item selected from among a flywheel, a motor, a generator, an air resistance device.

30. A ski-exercise device as claimed in claim 27 wherein said resistance device to provide resistance to forward movement includes an item selected from among a flywheel, a motor, a generator, an air resistance device.

* * * * *